US010760347B2

(12) United States Patent
Arefi et al.

(10) Patent No.: US 10,760,347 B2
(45) Date of Patent: Sep. 1, 2020

(54) SYSTEM AND METHOD FOR OFFLINE SUSPENSION OR CEMENTING OF TUBULARS

(71) Applicant: Schlumberger Technology Corporation, Sugar Land, TX (US)

(72) Inventors: Babak Bob Arefi, Spring, TX (US); Jacques Orban, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 246 days.

(21) Appl. No.: 15/464,976

(22) Filed: Mar. 21, 2017

(65) Prior Publication Data

US 2018/0274321 A1 Sep. 27, 2018

(51) Int. Cl.

| | |
|---|---|
| ***E21B 15/00*** | (2006.01) |
| ***E21B 33/04*** | (2006.01) |
| ***E21B 19/06*** | (2006.01) |
| ***E21B 19/07*** | (2006.01) |
| ***E21B 7/02*** | (2006.01) |
| ***E21B 19/10*** | (2006.01) |
| ***E21B 19/00*** | (2006.01) |
| ***E21B 33/14*** | (2006.01) |
| *E21B 33/05* | (2006.01) |

(52) U.S. Cl.

CPC ..... *E21B 15/003* (2013.01); *E21B 7/02* (2013.01); *E21B 19/06* (2013.01); *E21B 19/07* (2013.01); *E21B 19/10* (2013.01); *E21B 33/04* (2013.01); *E21B 33/14* (2013.01); *E21B 19/008* (2013.01); *E21B 33/05* (2013.01)

(58) Field of Classification Search

CPC ..... E21B 15/003; E21B 7/02; E21B 19/10; E21B 19/06; E21B 19/07; E21B 33/04; E21B 33/14

See application file for complete search history.

(56) References Cited

U.S. PATENT DOCUMENTS

| | | | | |
|---|---|---|---|---|
| 2005/0028980 | A1 | 2/2005 | Page et al. | |
| 2006/0076135 | A1 | 4/2006 | Rogers et al. | |
| 2011/0132624 | A1 | 6/2011 | Miller | |
| 2013/0319688 | A1 | 12/2013 | Moellendick | |
| 2015/0090450 | A1* | 4/2015 | Thiessen | E21B 15/003 166/285 |
| 2015/0343935 | A1 | 12/2015 | Fox | |
| 2016/0251912 | A1* | 9/2016 | Marcuccio | E21B 33/13 166/376 |
| 2017/0175457 | A1* | 6/2017 | Stanghelle | E21B 7/026 |

* cited by examiner

*Primary Examiner* — Nicole Coy
(74) *Attorney, Agent, or Firm* — Rachel E. Greene

(57) ABSTRACT

A system for offline suspension of a tubular including a first well having a first wellbore and a cellar formed at the surface of the first well with a rig movable from the first well to a second well. Additionally, a tubular string extending into the first well and a tubular support structure above the cellar of the first well, wherein the tubular support structure supports a weight of the tubular string such that the tubular is suspended from the tubular support structure independent from the rig and through a securing equipment configured to secure the first well.

41 Claims, 10 Drawing Sheets

SYSTEM AND METHOD FOR OFFLINE SUSPENSION OR CEMENTING OF TUBULARS

BACKGROUND

A cement job is performed when the drilling has lowered the casing in the well-bore. A cement job is the process of mixing a slurry of cement, cement additives and water and pumping it down through casing to critical points in the annulus around the casing or in the open hole below the casing string. Cement supports and protects well casings and helps achieve zonal isolation. Critical to safer, environmentally sound, and profitable wells, zonal isolation is created and maintained in the wellbore by the cementing process. The cement is deigned based on various well parameters, e.g., depth, wellbore geometry, temperature, pressure, and formation composition.

A casing profile includes multiple casing strings, such as conductor casing, surface casing, intermediate casing and production casing. Furthermore, each casing string undergoes a cement job. The large-diameter conductor casing protects shallow formations from contamination by drilling fluid and helps prevent washouts involving unconsolidated topsoils and sediments. Surface casing, the second string, has a smaller diameter, maintains borehole integrity and prevents contamination of shallow groundwater by hydrocarbons, subterranean brines and drilling fluids. The intermediate casing isolates hydrocarbon-bearing, abnormally pressured, fractured and lost circulation zones, providing well control as engineers drill deeper. Multiple strings of intermediate casing may be required to reach the target producing zone. The production casing, or liner, is the last and smallest tubular element in the well. It isolates the zones above and within the production zone and withstands all of the anticipated loads throughout the well's life.

Once the wellbore is lined with a casing, a cement head is installed above the rig floor to introduce cement into the well. The cement is pumped thru various cement lines traveling thru the cement head and into the well. During the cementing operation, the casing is typically supported by the rig hook and travelling block or the rotary table of the drilling rig. Furthermore, performing the cement job in oil and gas wells typically requires the drill-rig to be standing above the well during the operation for a fair amount of time (which can be up to a few days of non-productive time).

When multiple wells are drilled on a pad (land application), the drilling sequence may be based on batch drilling. With such process, the corresponding sections of all wells are drilled in series, requiring the rig to be moved from well to well after each section. Typically, a well section is drilled; then the casing is lowered into the well-bore and then cemented. The rig is not moved until after the cement has set, causing significant non-productive time.

SUMMARY OF DISCLOSURE

In one or more embodiments, a system for offline suspension of a tubular may include a first well, having a first wellbore and a cellar formed at the surface of the first well; a rig movable from the first well to a second well; a tubular string extending into the first well; and a tubular support structure above the cellar of the first well, wherein the tubular support structure supports a weight of the tubular string such that the tubular is suspended from the tubular support structure independent from the rig and through a securing equipment configured to secure the first well.

In one or more embodiments, a system for offline suspension of a tubular may include a rig movable from a first well to a second well; a first tubular string cemented in place within in the first well; a wellhead attached to the first tubular string and having a landing spool therein; a second tubular string extending into the first well through the wellhead and the first tubular string; a hanger attached to the upper end of the second tubular string, the hanger configured to engage the landing spool such that the tubular string hangs in tension from the wellhead upon engagement of the hanger with the landing spool; and a landing tool disposed above the wellhead and engaged with the tubular string.

In one or more embodiments, a method for using a rig may include supporting a weight of a first tubular string with the rig at a first well; transferring the weight of the first tubular string from off of the rig prior to cementing the first tubular string in place; and moving the rig from the first well.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1:
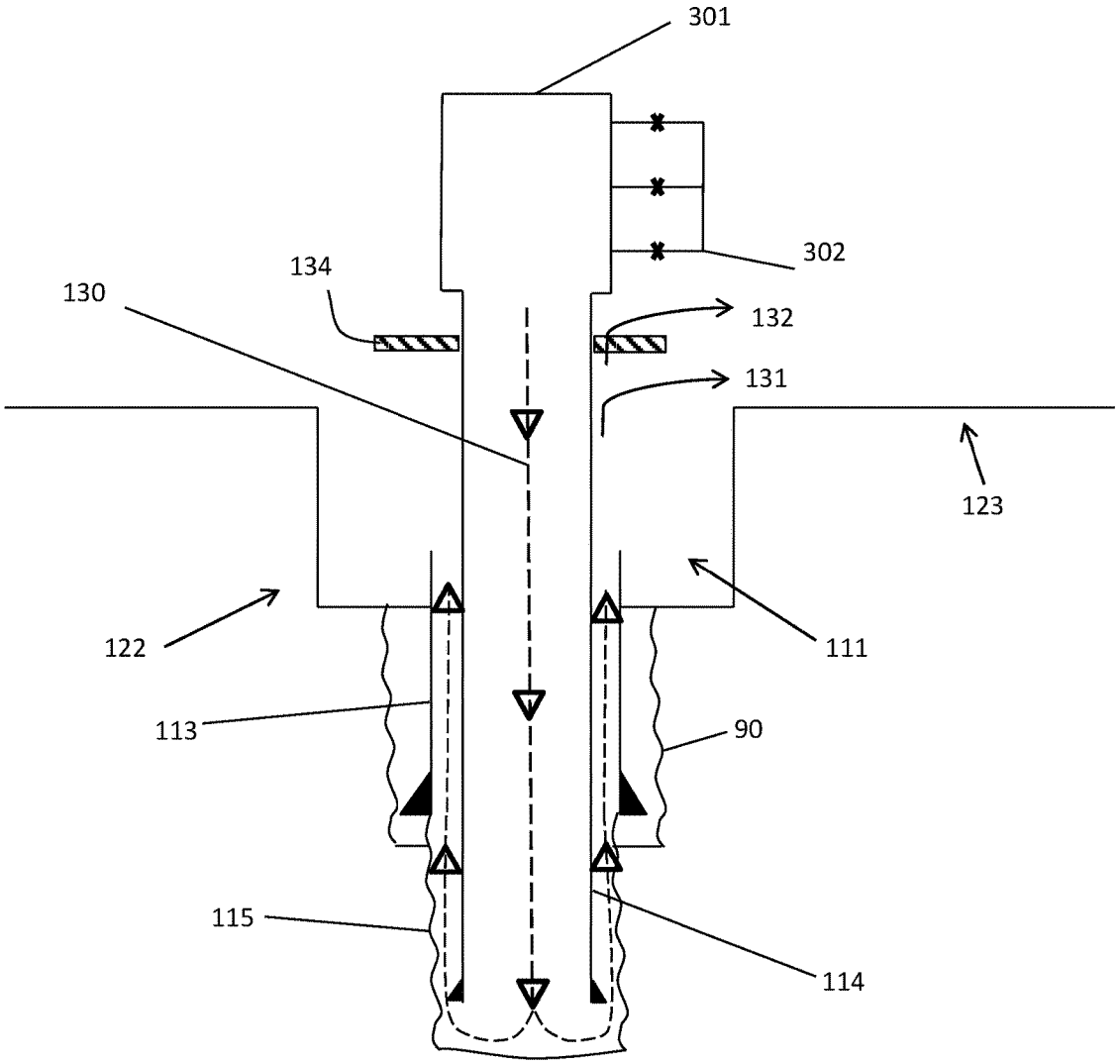
FIG. 1 illustrates a view of a system for offline running or cementing of tubulars suspended in a well according to one or more embodiments of the present disclosure.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Further, embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in other environments, such as sub-sea, without departing from the scope of the present disclosure. The embodiments are described merely as examples of useful applications, which are not limited to any specific details of the embodiments herein.

Embodiments of the present disclosure may be directed to systems and methods for the off-line running, suspending, or cementing of tubulars within a well. That is, tubular string may be run, suspended, and/or cemented in place within a well when a rig is no longer centered above the well, such as with a walkable rig. Thus, as or after the walkable rig has moved from a first well to a second well, the tubular in the first well may be run, suspended, and/or cemented in place without being supported by the rig in the conventional ways (travelling block or rotary table). When multiple wells are drilled on a pad (i.e. a land operation), the drilling sequence may be based on batch drilling. With such process, the corresponding sections of all wells are drilled in series, requiring the rig to be moved from well to well after each section. Typically, a well section is drilled; then the tubular is lowered into the well-bore. In conventional operations, the rig would suspend tubulars therein and would not be moved to a second well until after the first well's tubular has been cemented in place. In contrast, embodiments of the present disclosure provide for the tubular in the first well to be run, suspended, and/or cemented in place without being supported by the rig conventional methods, thus presenting a significant time and cost-savings where drilling of the second well can commence during the pumping of cement and/or curing of the cement in the first well, for example. As we discussed herein, running tubulars into the well, suspending, rotating, reciprocating, pumping through tubulars, pumping through annulus of tubulars, or even pulling tubulars out of the well (in the event of an emergency), with the weight of the tubular being held or supported by a structure other than the rig (so that the rig is free to be moved off of the well) are all envisioned as being embodiments of the present disclosure.

Various embodiments that allow for support of the tubular are envisioned and such embodiments may depend on the stage of the well in which the tubular is being emplaced. For example, the tubular can be supported by a system which may be independent of the rig's horizontal movement. Thus, the tubular may be attached to either a temporally installed structure below the rig floor, or to some rig components below the rig floor which may have some mechanical freedom in the horizontal plane (such as a rolling structure on horizontal rail). For some later sections, the tubular could also be landed in the well-head associated with previously cemented casing. Then the rig may be moved sideways (skidding or walking) towards the next the well to drill. In some instances, it may be desirable to cement the tubular in the well. Thus, as soon as the rig is moved or on the move, the cementing operation in the first well may be performed. After the cement job is completing, work at (or near) the well-head may be completed to secure the well.

Further, embodiments disclosed herein are described with terms designating in reference to a tubular, but any terms designating should not be deemed to limit the scope of the disclosure. For example, the tubular string is made up of numerous tubular pipes joined end-to-end, and each of the tubular pipes might be about twenty to forty feet in length. Further, the tubular pipes are hollow and thus provide a continuous channel of communication between the drill rig and the bottom of the wellbore, down through which a suitable fluid can be introduced to any region required within the well. It is to be further understood that the various embodiments described herein may be used with various types of tubulars, including but not limited to casing, without departing from the scope of the present disclosure. A casing generally refers to a large-diameter pipe that is lowered into an open hole and cemented in place.

As shown in FIG. 1, a system for offline suspension of a tubular in a well, in one or embodiments, is shown. In one or more embodiments, a first well 122, not under pressure, has a cellar 111. The cellar 111 may have a width of 6 feet by 8 feet in one or more embodiments; however, it is recognized that there is no limitation on the size of the cellar and it may take any shape or size for the purpose of the present disclosure. The cellar is commonly the first step toward the construction of the well. Additionally, the cellar may be made by a crew of workers before the drilling rig is brought to location. Furthermore, a conductor string 113 will extend a depth commonly of less than 100 feet into a wellbore 90 of the first well 122. The conductor string 113 is generally the first tubular string that is placed in a well (often into an unconsolidated formation), and will have the largest outer diameter of all of the eventual tubular that is run downhole in the first well 122. Conductor string 113 supports the surface formation from washout and may be placed during drilling or may be driven into place before drilling commences. Generally, the conductor string 113 is installed on location by the crew of workers before the drilling rig is brought to location.

Still referring to FIG. 1, in one or more embodiments, a tubular string 114 is being suspended in place. A weight of the tubular string 114 is suspended from a tubular support structure (which may take various forms, including the embodiments described in detail below) that is independent from any rig used to drill the well 122. While suspended from tubular support structure, tubular string 114 may also extend through a security equipment 134 that may be provided to secure the well in the event of a well control incident. The type of security equipment 134 is no limitation, and may be, for example, a blind shear ram or a tubular ram. Optionally, a cement head 301 may be installed at the top end of tubular string 114 in order to pump a cement slurry through the tubular string 114 and into the annulus via a plurality of cement lines 302 attached to the cement head 301. Specifically, the cement slurry may be pumped into the first well 122, down the inner diameter of the tubular string 114 and into the annulus created between the tubular string 114 and wellbore 115 according to conventional practices in the art for any cement job (see dotted arrow line). It is also envisioned that fluids other than cement may be pumped into the tubular 114 or into the annulus surrounding tubular 114 while the tubular 114 is suspended in the well by the tubular support structure.

After the cement is pumped downhole and displaced into the annulus, waiting on cement occurs prior to assessing whether the top of cement meets regulatory and safety requirements. In the event that any remedial cement jobs may need to be performed, they can be done at this time, including a top job using a small-diameter (macaroni) pipe (not shown) in the annulus or the tubular string 114 that may be perforated to circulate cement into the annulus via these perforations (not shown). Following the completion of the cement job, the well may be secured by a flange (not shown) attached onto a wellhead (not shown).

As mentioned, the cement slurry may be displaced into the annulus, thereby displacing a wellbore fluid from the annulus out of the well 122. Thus, a return line 131 may be installed either above or below the security equipment 134 in order to displace fluids (which may be cement slurry but also may be drilling or other wellbore fluids) from the annulus to a tank (not shown). Whether the return line 131 is above or below the security equipment 134 may depend, for example, on how the tubular is hung in the well and whether a flow path for the fluid exists above the security equipment 134. For example, if a tubular hanger (not shown) is fluted, the return line 131 may be installed above the security equipment 134 instead of below (as shown by arrow 132).

Figure 2:
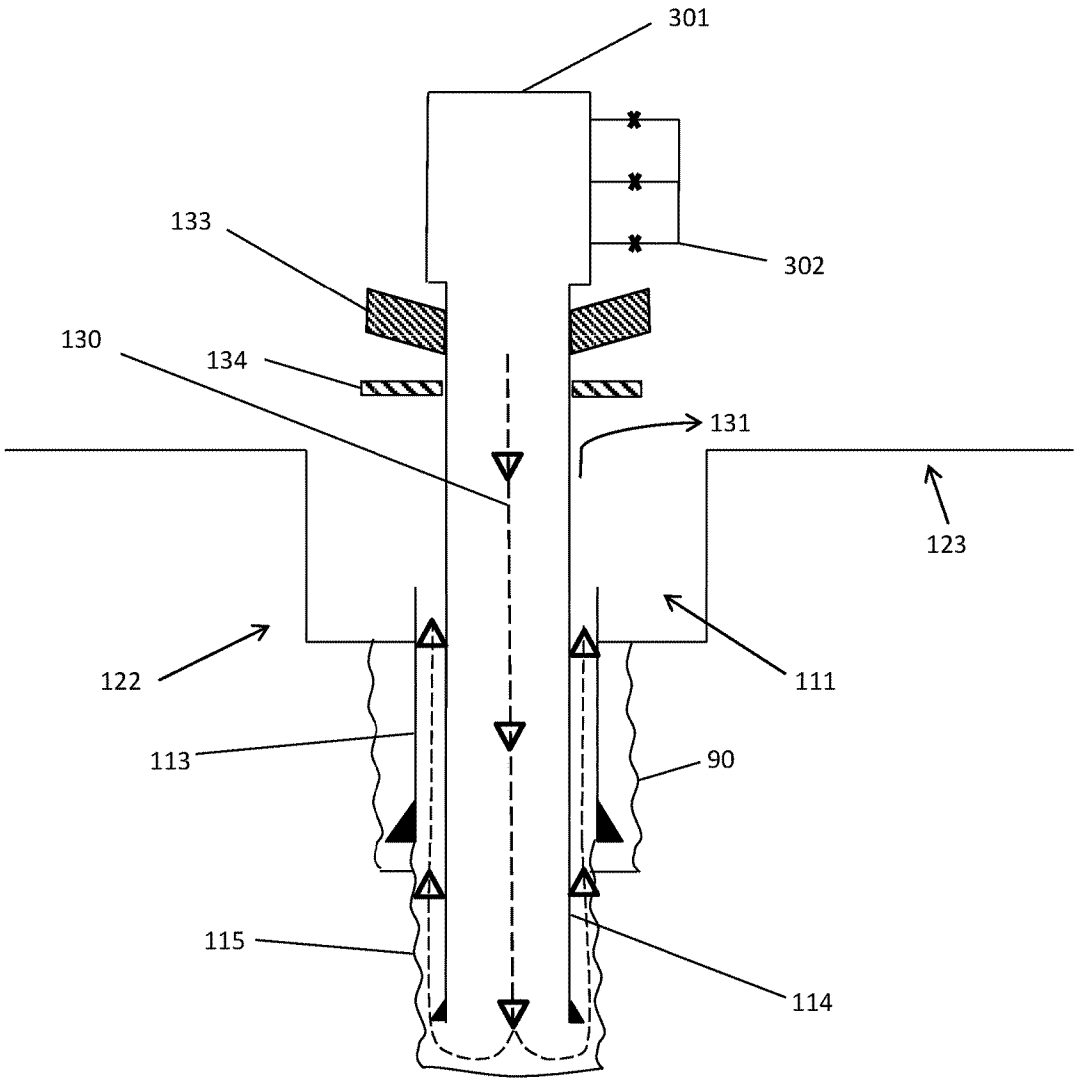
FIG. 2 illustrates a view of a system for offline running or cementing of tubulars suspended in a well under pressure according to one or more embodiments of the present disclosure.

As shown in FIG. 2, a system for offline suspension of tubular in a well under pressure, in one or embodiments, is shown. In one or more embodiments, a first well 122, under pressure, has a cellar 111. The cellar 111 may have a width of 6 feet by 8 feet in one or more embodiments; however, it is recognized that there is no limitation on the size of the cellar and it may take any shape or size for the purpose of the present disclosure. The cellar is commonly the first step toward the construction of the well. Additionally, the cellar may be made by a crew of workers before the drilling rig is brought to location. Furthermore, a conductor string 113 will extend a depth commonly of less than 100 feet into a wellbore 90 of the first well 122. The conductor string 113 is generally the first tubular string that is placed in a well (often into an unconsolidated formation), and will have the largest outer diameter of all of the eventual tubular string that is run downhole in the first well 122. Conductor string 113 supports the surface formation from washout and may be placed during drilling or may be driven into place before drilling commences. Generally, the conductor string 113 is installed on location by the crew of workers before the drilling rig is brought to location.

Still referring to FIG. 2, a weight of the tubular string 114 is suspended from a pushing equipment 133 (independent from any rig used to drill the well) and/or tubular support structure shown in the various embodiments below. The pushing equipment 133 is supported (directly or indirectly) by a floor 123 above the cellar 111. Additionally, a security equipment 134, such as a blind shear ram or a tubular ram, is below the pushing equipment 133 and engaged with the tubular string 114 to seal off the annulus created between the tubular string 114 and wellbore 115. Optionally, the tubular string 114 may be cemented in place. Thus, above the pushing equipment 133, a plurality of cement lines 302 are attached to a cement head 301. A cement slurry (not shown) is pumped through the plurality of cement lines 302 and through the cement head 301 and down through the tubular string 114 into the first well 122. The cement slurry may be pumped into the first well 122, down the inner diameter of the tubular string 114 and into the annulus created between the tubular string 114 and wellbore 115 according to conventional practices in the art for any cement job (see dotted arrow line). Additionally, the pushing equipment 133 may push the tubular string 114 into the wellbore 115 due to the well being under pressure. The pushing equipment 133 may help place the tubular string 114 at a predetermined depth and displace the cement slurry evenly throughout the annulus. After the cement is pumped downhole and displaced into the annulus, waiting on cement occurs prior to assessing whether the top of cement meets regulatory and safety requirements. In the event that any remedial cement jobs may need to be performed, they can be done at this time, including a top job using a small-diameter (macaroni) pipe (not shown) in the annulus or the tubular string 114 that may be perforated to circulate cement into the annulus via these perforations (not shown). Following the completion of the cement job, the well may be secured by a flange (not shown) attached onto a wellhead (not shown). Since the security equipment 134 seals off the annulus, a return line 131 may be installed below the security equipment 134 in order to displace the wellbore fluid from the annulus to a tank (not shown) as the cement slurry is pumped into the annulus.

Figure 3:
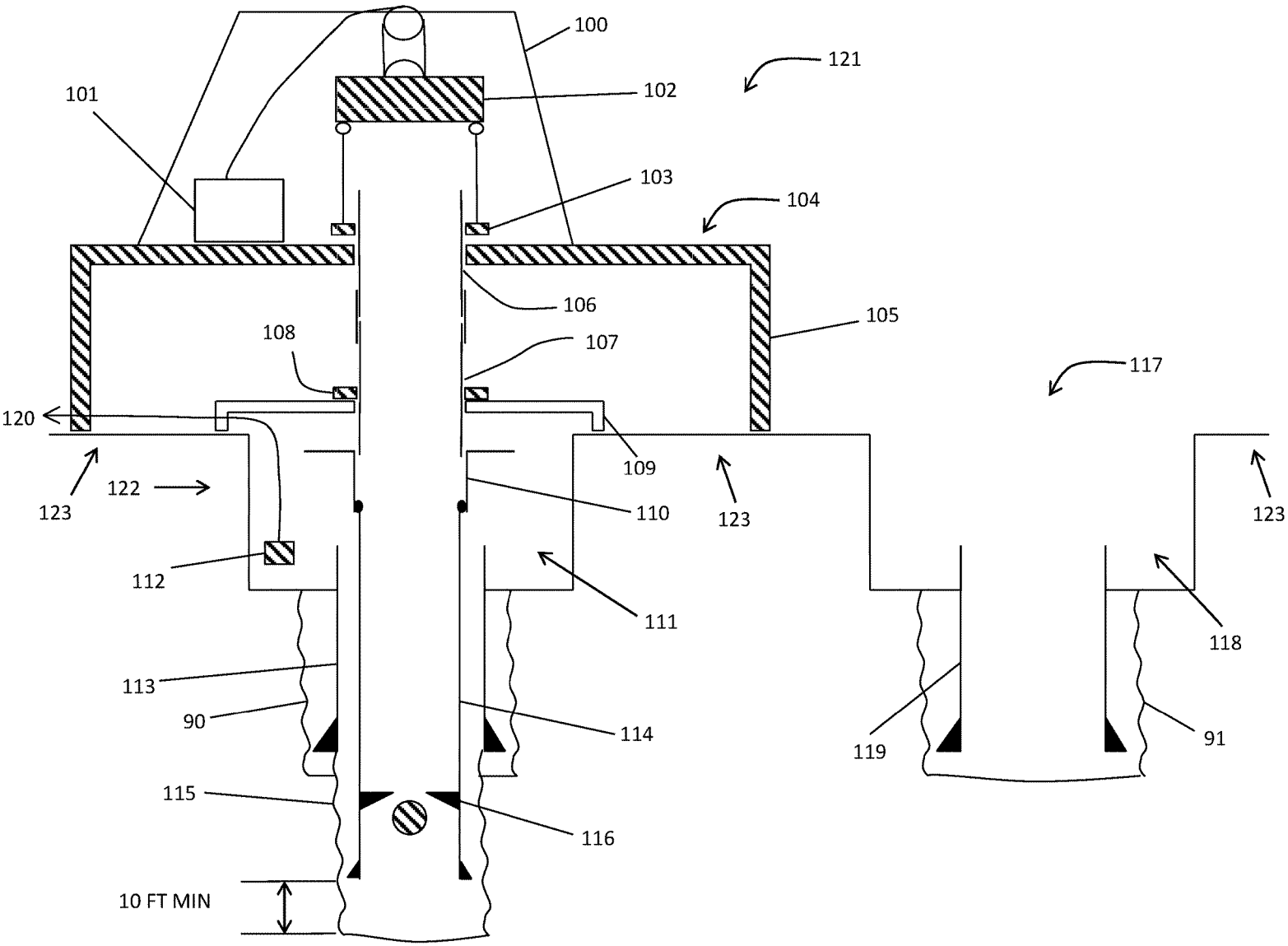
FIG. 3 illustrates a view of a system for preparing offline cementing of tubular with a tubular support bridge according to one or more embodiments of the present disclosure.

As shown in FIG. 3, a system for preparation of offline suspension of a tubular in a top section of a well, in one or embodiments, is shown. Referring to FIG. 3, a walking rig 121 is positioned over a first well 122 in preparation for offline suspension according to one or more embodiments of the present disclosure is shown. A second well 117 may be spaced apart, such as by 6 feet to 20 feet, from the first well 122. However, there is no limitation on the spacing between the wells. In one or more embodiments, each of first well 122 and second well 117 have a cellar 111, 118, respectively. The cellar 111, 118 may have a width of 6 feet by 8 feet in one or more embodiments; however, it is recognized that there is no limitation on the size of the cellar and it may take any shape or size for the purpose of the present disclosure. The cellar is commonly the first step toward the construction of the well. Additionally, the cellar may be made by a crew of workers before the drilling rig is brought to location. Furthermore, a conductor string 113, 119 will extend a depth commonly of less than 100 feet into a wellbore 90 of the first well 122 and a wellbore 91 of the second well 117, respectively. The conductor string 113, 119 is generally the first tubular string that is placed in a well (often into an unconsolidated formation), and will have the largest outer diameter of all of the eventual tubular string that is run downhole in each well 122, 117. Conductor string 113, 119 supports the surface formation from washout and may be placed during drilling or may be driven into place before drilling commences. Generally, the conductor string 113, 119 is installed on location by the crew of workers before the drilling rig is brought to location.

When drilling a first section 115 of the well 122 with the walking rig 121, a drilling fluid is pumped into the well 122 and may return to surface through the bore of the conductor pipe 113 and may accumulate in the cellar 111. A cellar pump 112 may be disposed in the cellar 111 to ensure the cellar 111 is kept clean of debris and liquids while operations are being performed on the first well 122. A cellar pump line 120 shows the path at which debris and liquids travel out of the cellar 111 of the first well 122. It is understood that each subsequent well, including second well 117, may have a similar cellar, cellar pump, etc.

The walking rig 121, according to one or more embodiments, may be movable from first well 122 to second well 117, without necessitating disassembly and reassembly. The design or nature of the walkability or the skiddability is not a limitation on the present disclosure. In fact, the present disclosure may be used in conjunction with any walkable rig or even non-walkable rig that may be moved from first well 122 to second well 177; however, the convenience of a walking rig may be beneficial. However, as shown, walking rig 121 includes a substructure 105 having a rig floor 104 and a mast 100 disposed on the rig floor 104. The mast 100 has a traveling block 102 powered by a drawwork 101, which is disposed on the rig floor 104. As seen in FIG. 3, the walking rig 121 is positioned on the first well 122, such that the substructure 105 is disposed on a floor 123 above the cellar 111 of the first well 122. In FIG. 3, the substructure(s) 105 are shown perpendicular to the direction of the two (or more) cellars for explanation purposes. However, one of ordinary skill in art would appreciate that in most applications, the substructure 105 is parallel to the direction defined by the cellars 111, 118. With such overall design, the rig 104 can easily walked for the position shown in FIG. 3 (above the well 122) to the location above the cellar 118 of the well 117. Tubular string 114 may be placed in the well by conventional means such as an upper tubular elevator 103 in conjunction with a landing tool. Specifically, as shown, upper tubular elevator 103 is connected to the traveling block 102, and the upper tubular elevator 103 engages an upper landing tool 106. The upper landing tool 106 may engage a lower landing tool 107, and both are used to aid in the lowering the tubular string 114 which may include a wellhead 110 into the wellbore 115 of the first well 122. Furthermore, a plurality of tubular centralizers or scrapers (not shown here, but shown, for example, in FIG. 9) may optionally be used to keep the tubular string centered in the wellbore 115. The lower landing tool 107 further engages the tubular string 114 optionally within the wellhead 110. In one or more embodiments, a plurality of floats valves 116 may be disposed in the wellbore 115 at the bottom of the tubular string 114. While the tubular string 114 is emplaced and supported by upper tubular elevator 103 in conjunction with upper landing tool 106 and lower landing tool 107 optionally through wellhead 110, in accordance with the present disclosure, the weight of tubular string 114 may be transferred off of such components (and the rig generally) in preparation for and during the offline suspension (and optional cementing) of the tubular string 114. In one or more embodiments, the bottom of the tubular string 114 may be a minimum of 10 feet away from the bottom of the wellbore 115. Further, the length of the tubular string 114 is determined by well parameters and is not a limitation on the scope of the present disclosure.

As mentioned above, in accordance with methods of the present disclosure, the weight of the tubular is transferred off of the mast (for example, through the upper tubular elevator and upper landing tool) so as to enable offline suspension (and optional cementing) of the tubular in the well. With one or more embodiment, when it is transferred off of the mast, it is transferred onto a tubular support structure. For example, as shown in FIG. 3, a tubular support structure, such as tubular support bridge 109 is disposed on ground 123 above cellar 111. Tubular support bridge 109 may be sufficiently dimensioned to distribute the total supported weight of a given tubular string such that it distributes the weight on sufficient ground 123 area to avoid the collapse of the cellar 111. A lower tubular slip or elevator 108 is disposed on the tubular support bridge 109 and may engage with the lower landing tool 107 or even with the upper portion of the tubular string 114. Upon engagement of the lower tubular slip or elevator 108 with the lower landing tool 107, the lower landing tool 107 may be disengaged from the upper landing tool 106. Similarly, upper landing tool 106 and upper tubular elevator 103 may disengage from tubular string 114.

Figure 4:
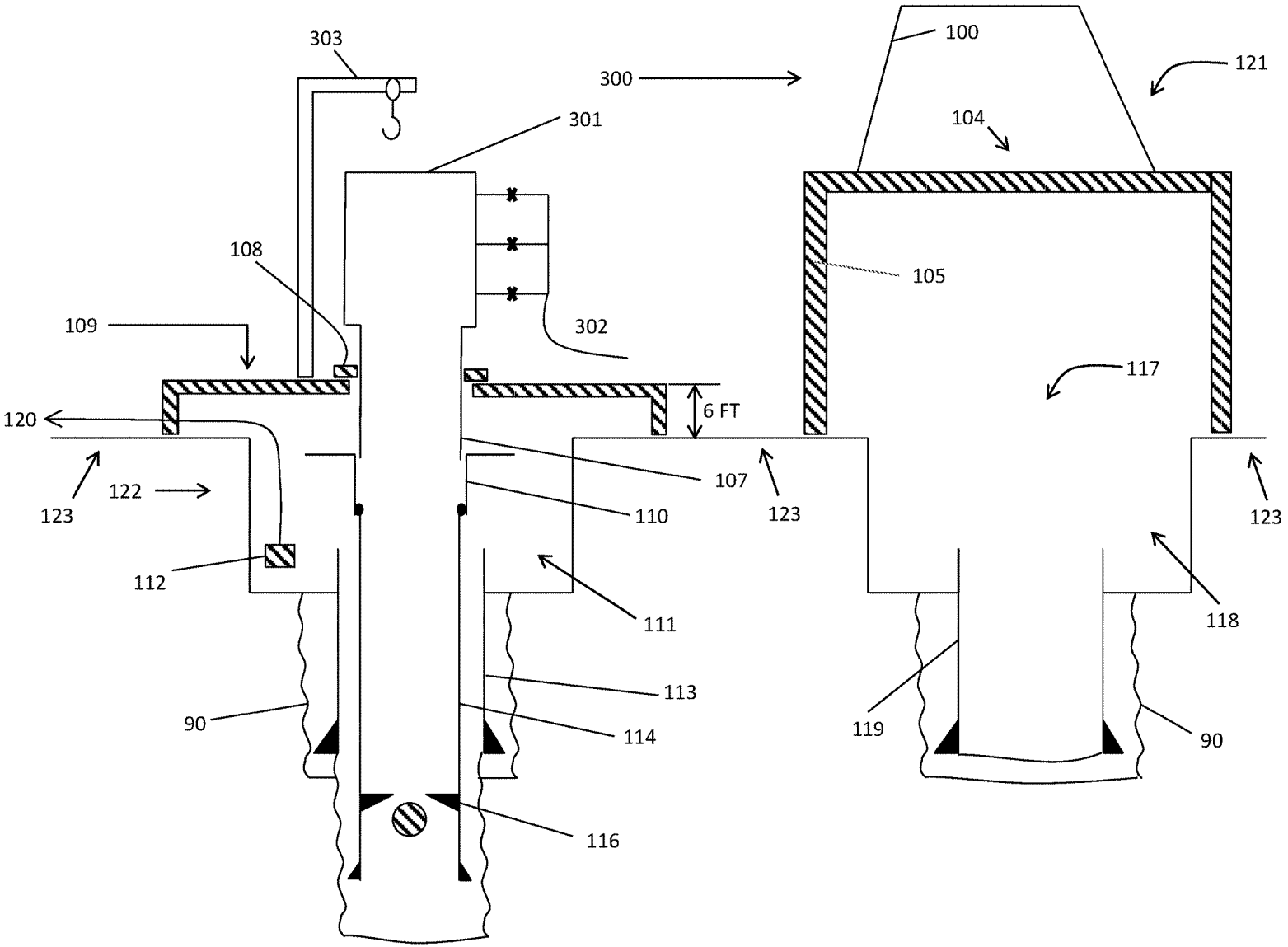
FIG. 4 illustrates a view of a system for offline cementing of tubular according to one or more embodiments of the present disclosure.

Now referring to FIG. 4, the cementing of the well 122 shown in FIG. 3 is shown. Thus, in one or more embodiments, the walking rig 121 is moving or has moved (as seen by the arrow 300) from the first well 122 to the second well 117. The rig displacement may be feasible as the walking rig 121 is oriented in a direction parallel to the two wells 117 and 122 (and not perpendicular as shown for convenience in FIG. 4). Thus, substructure 105 is now disposed on the ground 123 above the cellar 118 of the second well 117. The lower landing tool 107 (disengaged from the upper landing tool 106), the wellhead 110, and the tubular string 114 are within the first well 122, and a cement head 301 is installed above the lower landing tool 107. The tubular support bridge 109 disposed on the ground 123 above the cellar 111 of the first well 122 now supports a weight of the lower landing tool 107, the tubular string 114, optionally the wellhead 110, and the cement head 301. The tubular support structure, shown in this embodiment as the tubular support bridge 109, ultimately bears the weight of the tubular string 114, as well as other components in place to engage and cement the well. In this embodiment, the tubular string 114 is a surface casing, i.e., a tubular having a relatively large diameter that provides structural strength to the well for subsequent tubular strings to be suspended within the surface tubular string 114. The length of the conductor string 113 is often short in comparison with the length of the surface tubular string 114. Thus, most of the newly cemented section of the surface tubular string 114 is facing the new open hole 115 so that proper sealing and support of the surface tubular string 114 may be provided by this section of this open-hole 115.

Furthermore, the lower landing tool 107 is disposed in between the wellhead 110 and cement head 301, and engages with the tubular string 114 and the tubular slip or elevator 108. Additionally, a small crane 303 may optionally be disposed on the tubular support bridge 109. The small crane 303 may be used, for example, to assist in the installation of cement head 301 on the lower landing tool 107 or to hold a wireline spool (not shown) or aid in the lifting or support of any tools needed for any operation to the first well 122. Once the cement job is ready to be performed, a plurality of cement lines 302 are attached to the cement head 301. A cement slurry (not shown) is pumped through the plurality of cement lines 302 and through the cement head 301 and down through the tubular string 114 into the first well 122. The cement slurry may be pumped into the first well 122, down the inner diameter of the tubular string 114 and into the annulus created between the tubular string 114 and wellbore 115 according to conventional practices in the art for any cement job. After the cement is pumped downhole and displaced into the annulus, waiting on cement occurs prior to assessing whether the top of cement meets regulatory and safety requirements. In the event that any remedial cement jobs may need to be performed, they can be done at this time, including a top job using a small-diameter (macaroni) pipe (not shown) in the annulus or the tubular string 114 may be perforated to circulate cement into the annulus via these perforations (not shown). Following the completion of the cement job, the well may be secured, for example, by a flange (not shown) attached onto the wellhead 110. A valve (not shown) may also be installed on the wellhead 110 side connection so that potential pressure may be bled before removing the flange when subsequent sections are to be drilled. Further, an additional pressure barrier may include a tubular float valve (not shown) or the cement may have been displaced with a fluid that has an adequate density to create an over-balance in the well.

Figure 5:
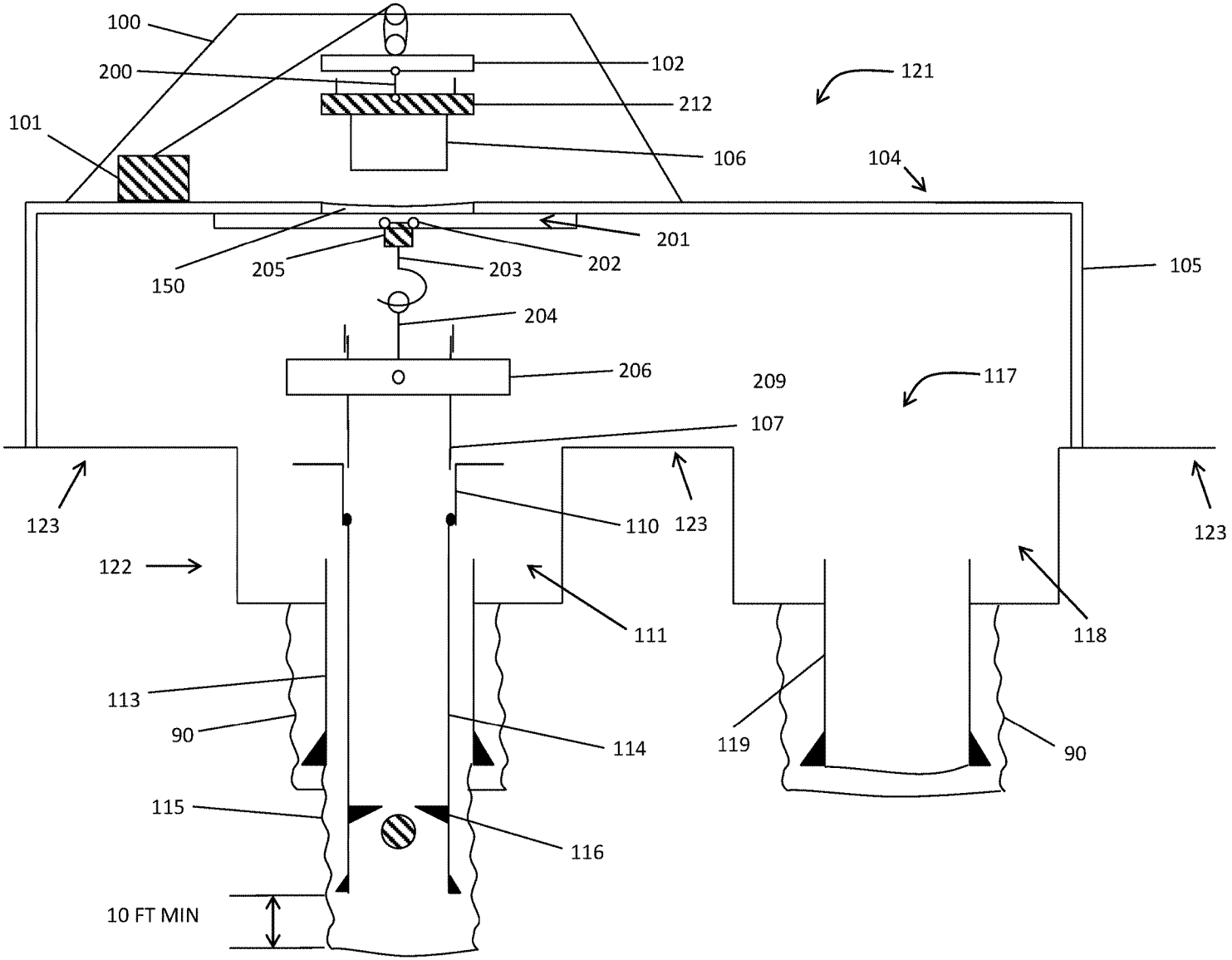
FIG. 5 illustrates a view of a system for preparing offline cementing of tubular with a blowout preventer (BOP) Winch according to one or more embodiments of the present disclosure.

As shown in FIG. 5, another embodiment of a system for preparation of offline suspension (and optional cementing) of a tubular in a top section of a well, i.e, a surface casing, is shown. Referring to FIG. 5, in one or more embodiments, the walking rig 121 is positioned on the first well 121. A second well 117 is adjacent the first well 122. Walking rig 121 includes a substructure 105 having a rig floor 104 and a mast 100 disposed on the rig floor 104. The mast 100 has a traveling block 102 powered by a drawwork 101, which is disposed on the rig floor 104. In this embodiment, while mast 100 is centered over first well 122, the substructure 105 extends over at least first well 122 and second well 117. That is, substructure is disposed on a ground 123 above both the cellar 111 of the first well 122 and the cellar 118 of the second well 117. In FIG. 5, the substructure 105 is shown to be perpendicular to the direction of the multiple cellars for ease in illustration. In common application, the substructures 105 would be parallel to that cellar direction. Such embodiments may be used, for example, when the cellar 111 of the first well 122 and the cellar 118 of the second well 117 are relatively closely spaced, such as by 6 feet apart, rather than being 20 feet apart. Thus, one of ordinary skill in the art will appreciate how the walking rig 121 can encompass both the first well 122 and the second well 117 to provide time saving operations. The walking rig 121 may move, for example, at a rate of 1 to 2 feet per minute; however such rate is not a limitation on the present disclosure.

As illustrated in FIG. 5, the upper landing tool 106 and the lower landing tool 107 are disengaged from one another; however, it may be understood that upper landing tool 106 and lower landing tool 107 may be used to place the surface tubular string 114 in the well. An upper tubular elevator 212, connected to the traveling block 102 through an upper bail 200, supports the upper landing tool 106. As stated above, the tubular support structure is not limited to the tubular support bridge 109, shown in FIG. 3. Rather, FIG. 5 illustrates another example of a tubular support structure that may be used to suspend the weight of the tubular string independent of the rig such that the rig may move off the well during the suspension, cementing and waiting on cement, for example.

As illustrated in FIG. 5, one or more blowout preventer (BOP) winches 205 (a winch that is conventionally used to handle BOPs) is used as the tubular support structure. Specifically, one or more rails 201 are connected either to the rig floor 104 or to the substructure 105. As previously mentioned, it is common that the substructures 105 are parallel to the direction defined by the multiple cellars 111, 118. With such construction, the one or more rails 201 would also be parallel to the substructure. The rig of FIG. 5 is represented with the one or more rails 201 and substructure 105 being perpendicular for convenience of illustration, but could be used as well. The one or more rails 201 (and the one or more winches 205) are laid on each side of a central hole 150 in the rig floor 104 (typically through the rotary table) to allow the passage of well tubular (drill-sting and casing). The one or more BOP winch 205 are disposed on the one or more rails 201, and a plurality of winch wheels 202 allows the one or more BOP winches 205 to move along the one or more rails 201. The plurality of winch wheels 202 may be any connection known in the art to allow an apparatus to move against another apparatus (i.e. tires and wheels). When the walking rig 121 moves, the plurality of winch wheels 202 may allow rig displacement while the one or more BOP winches 205 stays in its initial vertical position above the first well 122. Additionally, a cable hook 203 extends from the one or more BOP winch 205 to engage with a lower bail 204. The lower bail 204 connects to a lower tubular elevator 206, which engages and supports the lower landing tool 107 (which, as mentioned above, has already been disengaged from upper landing tool 106 as illustrated in this system). In one or more embodiments, the elevator 206 may be hung on the one or more BOP winches 205 before the start of lowering the first tubular element of the tubular string 114. During the procedure to lower the tubular string 114 into the well 122, the tubular string 114 may slide in the bore of the elevator 206 hung onto the one or more BOP winches 205. Once the tubular string 114 has reached the desired depth in the wellbore 115 thanks to the usage of the mast 100, travelling block 102 and bails 200 and elevator 212, the weight of the tubular string 114 may be transferred to the tubular elevator 206 hung on the winch 205. Then the upper part of the running tool 106 can be decoupled from the lower part of the running tool 107 and lifted above the rig floor 104. In such condition, the walking rig 121 may leave the first well 122, and cementing of the tubular string 114 within the first well 122 may commence. In this embodiment, as walking rig 121 is moved from first well 122 to second well 117, the tubular support structure (BOP winch 205 equipped with wheel 202) stays stationary with respect to the first well 122, and thus does not move with walking rig 121. As illustrated, however, the substructure 105 (on which the rail 201 supporting the BOP winch 205 is mounted) extends over both first well 122 and second well 117. Thus, as walking rig 121 moves, substructure 105 (and thus rail 201 and BOP winch) may stay positioned over first well 122. Also, the displacement of the rig 121 would be facilitated with substructures parallel to the direction of the multiple cellars.

Figure 6:
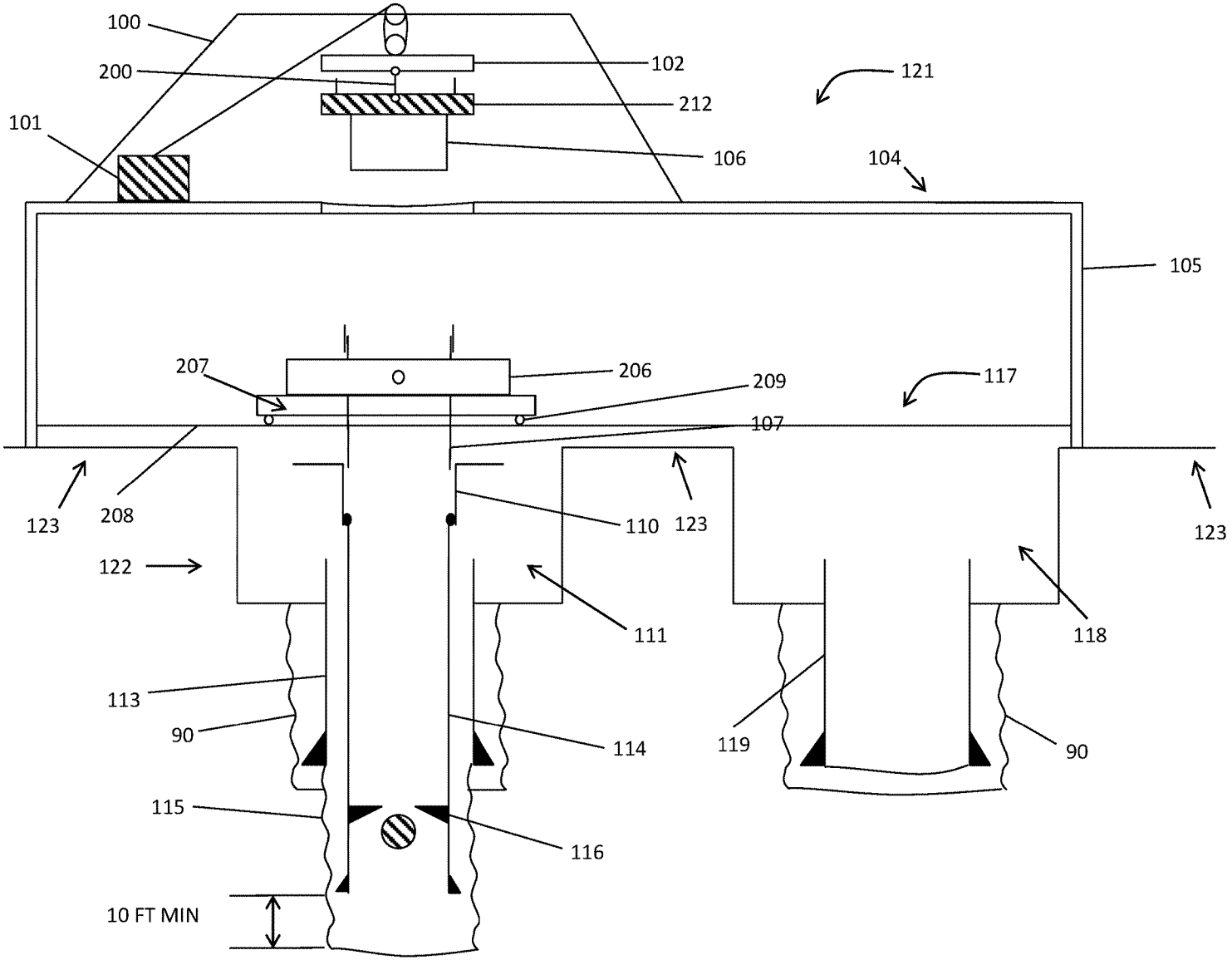
FIG. 6 illustrates a view of a system for preparing offline cementing of tubular with a rolling bridge according to one or more embodiments of the present disclosure.

Referring now to FIG. 6, another embodiment of a system for preparation of offline suspension (and optional cementing) of a tubular in a top section of a well, i.e, a surface casing, is shown. Referring to FIG. 6, in one or more embodiments, the walking rig 121 is positioned on the first well 121. A second well 117 is adjacent the first well 122. Walking rig 121 includes a substructure 105 having a rig floor 104 and a mast 100 disposed on the rig floor 104. The mast 100 has a traveling block 102 powered by a drawwork 101, which is disposed on the rig floor 104. In this embodiment, while mast 100 is centered over first well 122, the substructure 105 extends over at least first well 122 and second well 117. That is, substructure is disposed on a floor 123 above both the cellar 111 of the first well 122 and the cellar 118 of the second well 117. Such embodiments may be used, for example, when the cellar 111 of the first well 122 and the cellar 118 of the second well 117 are relatively closely spaced, such as by 6 feet apart, rather than being 20 feet apart. Thus, one of ordinary skill in the art will appreciate how the substructure 105 can encompass both the first well 122 and the second well 117 to provide time saving operations. The walking rig 121 may move, for example, at a rate of 1 to 2 feet per minute; however, such rate is not a limitation on the present disclosure.

As illustrated in FIG. 6, in one or more embodiments, a rolling bridge 207 is used as the tubular support structure. Specifically, a one or more rails 208 are attached to the substructure 105. The one or more of rails 208 may be used to support the BOP wrangler (not shown) during the installation of the BOP above the well head 110 generally attached above the surface tubular string 114. Rails 208 also support rolling bridge 207. As shown by FIG. 6, a more conventional rig design of the rig as seen in line with the multiple cellars 111, 118. In such view, it is more obvious to understand the location of the rails 208 attached to the substructure 105 (as well as the rails 201 attached below the rig floor 104, as illustrated in FIG. 3). In FIG. 6, the substructures 105 are parallel to the direction of the multiple cellars 111, 118. Specifically, rolling bridge 207 has wheel 209 to connect and allow the rolling bridge 207 to move on the one or more rails 208. The wheel 209 may be any connection known in the art to allow an apparatus to move against another apparatus (i.e. tires and wheels). Additionally, also disposed on rolling bridge 207 is the lower tubular elevator 206, which engages and supports the lower landing tool 107. In one or more embodiments, the elevator 206 may be supported by the rolling bridge 207 before the start of lowering the first tubular element of the tubular string 114. During the procedure to lower the tubular string 114 into the well 122, the tubular string 114 must slide in the bore of the elevator 206 supported by the rolling bridge 207. Once the tubular string 114 has reached the desired depth in the wellbore 115 by the use of the mast 100, travelling block 102 and bails 200 and elevator 212, the weight of the tubular string 114 can be transferred to the tubular elevator 206 supported by the rolling bridge 207. Then the upper part of the running tool 106 can be decoupled from the lower part of the running tool 107 and lifted above the rig floor 104.

Still referring to FIG. 6, once the tubular string 114 has reached the desired depth in the wellbore 115, and the weight of the tubular string 114 has been transferred to the tubular elevator 206, the walking rig 121 may leave the first well 122, and offline suspension of the tubular string 114 within the first well 122 may commence. When the tubular string 114 is to be cemented in place, the cement head (as shown in FIG. 4) is installed on the lower part of the running tool 107. Then the cement line (as shown in FIG. 4) can be connected to the cement head (as shown in FIG. 4). This means that these components are located below the rig floor. When the cement job is completed, the wellhead 110 may be ready for supporting any additional tubular string after the drilling of additional well sections. When using the wellhead 110 as shown in FIG. 5 or 6, such wellhead 110 is connected on top of the tubular string 114 and maintained in proper place during the cement job by the lower running tool 107 supported by the elevator 206. In some other implementations, the wellhead 110 may have to be added after the placement and hardening (setting) of the cement. As the walking rig 121 may be moved to the other well 117 for its own drilling and construction, the first well 122 may be left unattended for some time. To insure proper protection of the well 122 during this period, the wellhead 110 may be covered with a flange. To allow proper monitoring of potential appearance of pressure inside the tubular string 114, a valve 518 and line 512 (shown in FIG. 8) may have to be added. With these additional equipment, pressure inside the tubular string can be monitored and bleeding can be performed.

Figure 7:
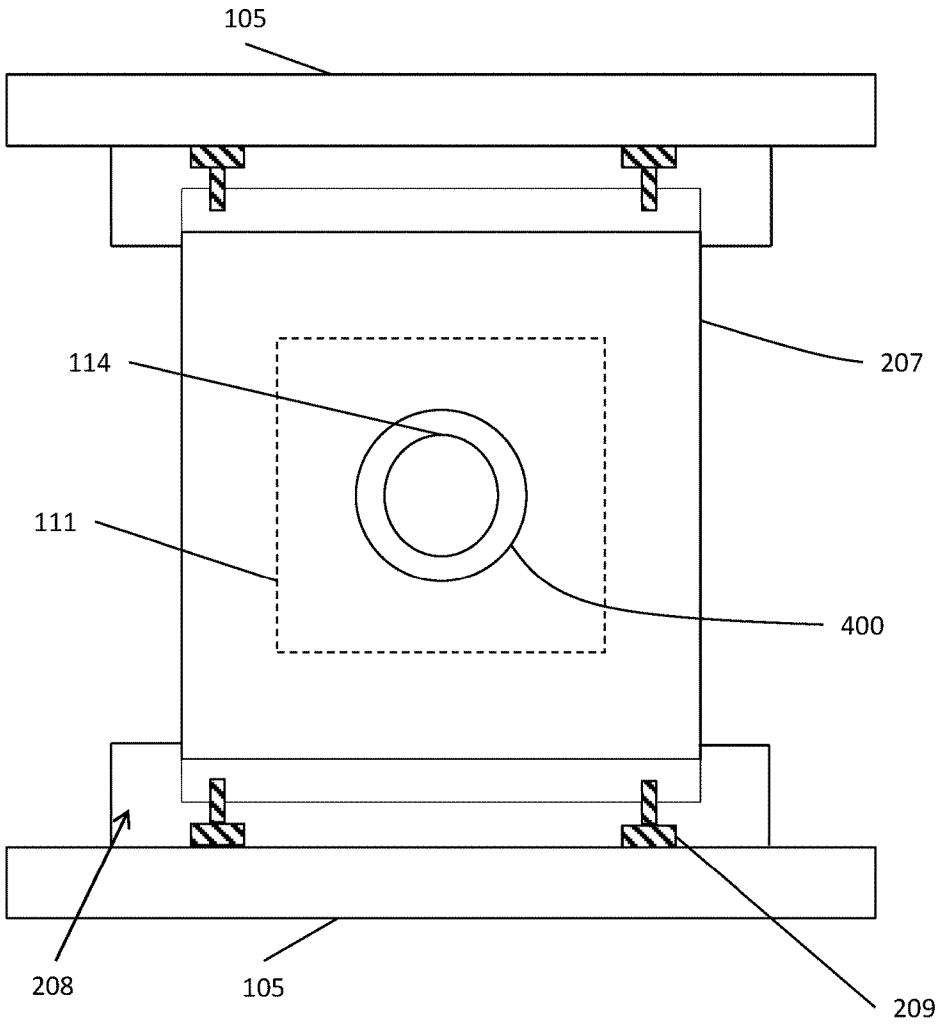
FIG. 7 illustrates a top view of a rolling bridge according to one or more embodiments of the present disclosure.

In FIG. 7, in one or more embodiments, a top view of the rolling bridge 207 as the tubular support structure is shown. The rolling bridge 207 has an opening 400 to receive the tubular string 114. Additionally, the one or more rails 208 are attached to the substructure 105. The one or more of rails 208 may be used to support the BOP wrangler (not shown) during the installation of the BOP above the well head typically attached above the surface tubular string (not shown) and supports rolling bridge 207. Rolling bridge 207 has wheel 209 to connect and allow the rolling bridge 207 to move on the one or more rails 208. The wheel 209 may be any connection known in the art to allow an apparatus to move against another apparatus (i.e. tires and wheels, etc.).

Figure 8:
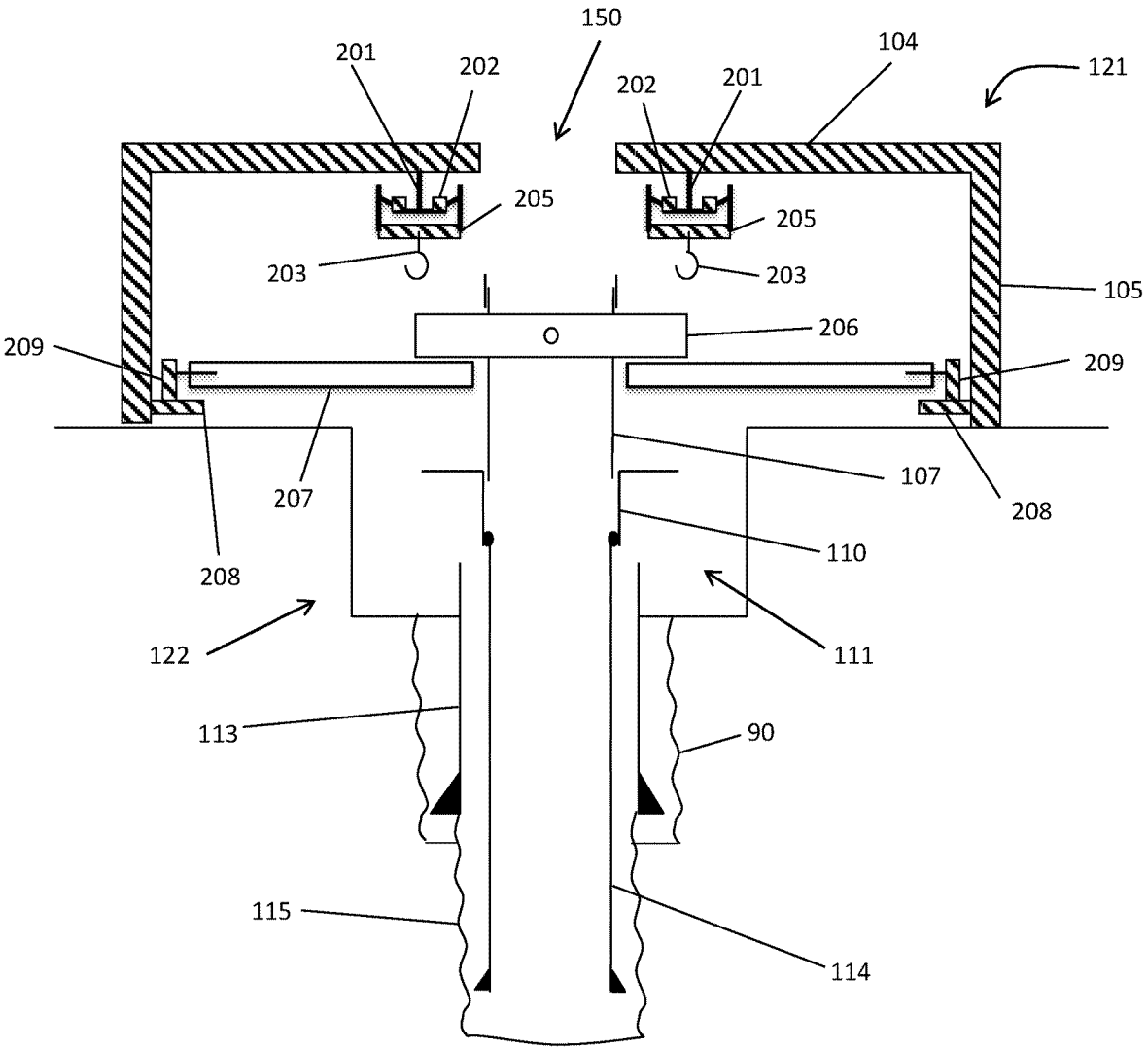
FIG. 8 illustrates a view of a system for preparing offline cementing of tubular with a rolling bridge and a blowout preventer (BOP) winch according to one or more embodiments of the present disclosure.

Now referring to FIG. 8, in one or more embodiments, a view of the walking rig 121 parallel to the cellar 111 of the first well 122 is shown. A second well (not shown based on the orientation of the view) may be aligned with the direction of the cellar 111, and the substructures 105 are parallel to that direction. Furthermore, the combination of the one or more BOP winches 205 and the rolling bridge 207 may be used to support the surface tubular string 114. As described above, one or more rails 208 are attached to the substructure 105. The one or more of rails 208 may be used to support the BOP wrangler (not shown) during the installation of the BOP above the well head 110 which is generally attached above the surface tubular string 114. Rails 208 also support rolling bridge 207. Additionally, the rolling bridge 207 has a wheel 209 to connect and allow the rolling bridge 207 to move on the one or more rails 208. The wheel 209 may be any connection known in the art to allow an apparatus to move against another apparatus (i.e. tires and wheels). Additionally, also disposed on rolling bridge 207 is the lower tubular elevator 206, which engages and supports the lower landing tool 107.

Also shown in FIG. 8 are one or more rails 201 connected either to the rig floor 104 or to the substructure 105. The one or more rails 201 (and the one or more winches 205) are laid on each side of a central hole 150 in the rig floor 104 (typically through a rotary table) to allow the passage of well tubular (drill-sting and casing). The one or more BOP winches 205 are disposed on the one or more rails 201, and a plurality of winch wheels 202 allows the one or more BOP winches 205 to move along the one or more rails 201. The plurality of winch wheels 202 may be any connection known in the art to allow an apparatus to move against another apparatus (i.e. tires and wheels).

Figure 9:
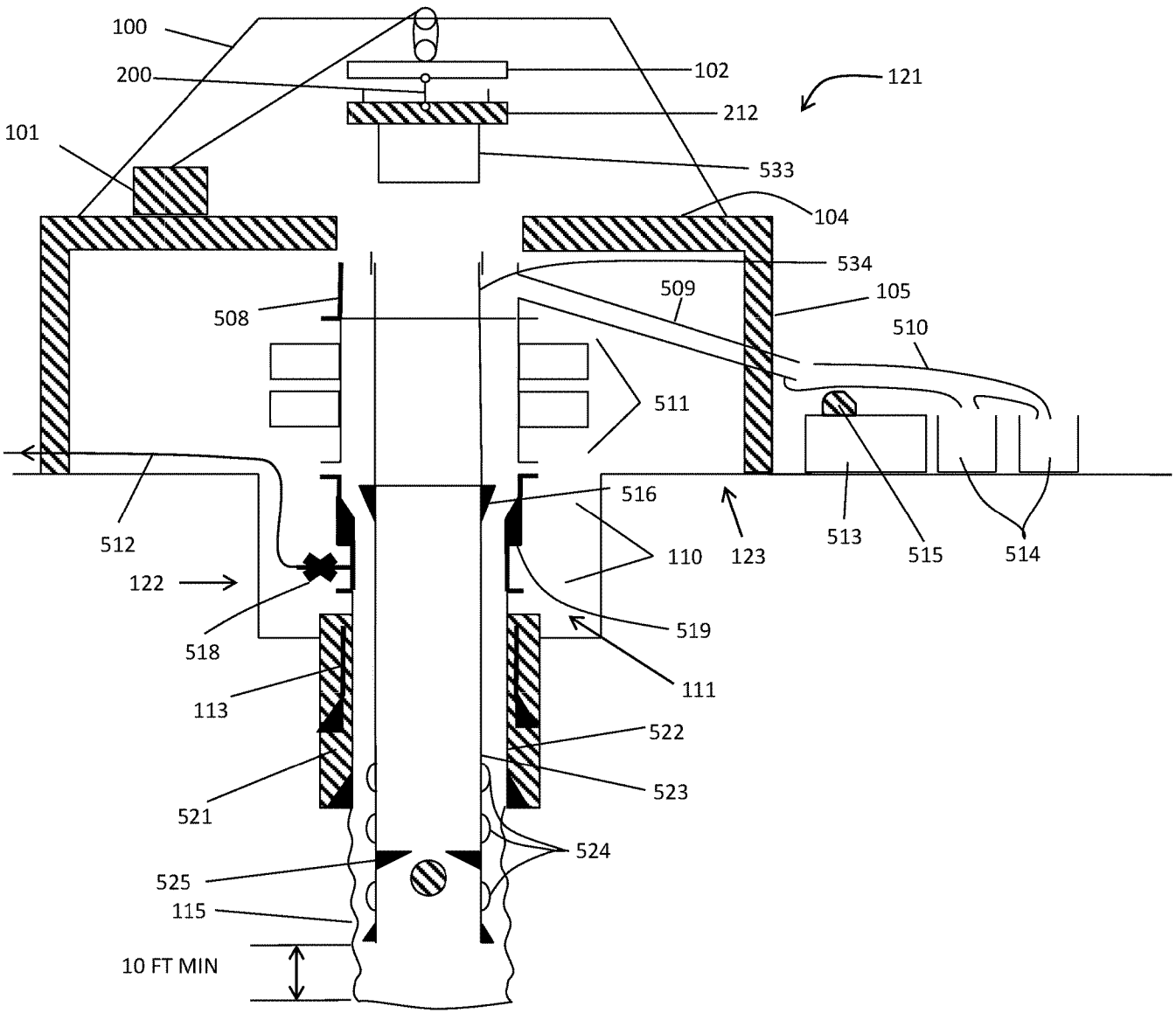
FIG. 9 illustrates a view of a system for offline cementing of tubular in presence of a well-head according to one or more embodiments of the present disclosure.

Now referring to FIG. 9, an embodiment of a system for the offline suspension (and optional cementing) of intermediate and/or production tubular is shown. In one or more embodiments, the walking rig 121 is positioned on the first well 122. A second well (not shown) is adjacent the first well 122: the second well may be shown as the view may be aligned with the direction of the multiple cellars, and the substructures 105 are parallel to that direction. Walking rig 121 includes a substructure 105 having a rig floor 104 and a mast 100 disposed on the rig floor 104. The mast 100 has a traveling block 102 powered by a drawwork 101, which is disposed on the rig floor 104. An upper tubular elevator 212, connected to the traveling block 102 through an upper bail 200, supports an upper landing tool 533.

As illustrated, a first tubular string 522 (which may, for example, be a surface tubular string such as that shown in FIG. 3-6 or 8) is in the wellbore 115 of the first well 122 and secured therein by a cement section 521. Wellhead 110 is attached to first tubular string 522. Additionally, while walking rig 121 is positioned at the first well 122, which has already had first tubular string 522 cemented in place, it is envisioned that the walking rig 121 did not necessarily remain in such position during the cementing, but may have been relocated to a second well (or any number of other wells) for drilling of their top sections prior to relocating back at first well 122 to ensure the continuation of the construction of the first well 122 (including the drilling of the open-hole 115). The wellhead 110 has been added during or after the installation the surface tubular string 522. After the cement job of the surface tubular string 522, the wellhead 110 can support the upper section of any additional tubular strings (i.e., second tubular string 523) via the proper usage of tubular slips, wedges or flanges. When the wellhead installation has been completed and the cement sheet hardened, the BOP 511 can then be installed on top of the wellhead 111. The bell-nipple 508 and return-line 509 may be connected and disconnected from the BOP 511 at different stages of the well construction. The well 122 may be left secured by proper closing at its top. This can be achieved by leaving the BOP 511 with its blind rom closed on top the wellhead 110. If the BOP 511 must be removed, a flange (not shown) may be installed on the wellhead 110. Further, one skilled in the art would appreciate that the walking rig 121 can travel to a plurality of wells and is not constrained to traveling in any particular order. Further, while it is envisioned that the first tubular string 522 may have been cemented in place without the walking rig 121 being positioned at the first well 122 (such by the systems described above), it is also envisioned that first tubular string 522 may have been cemented in place using conventional means for supporting the tubular string, i.e., via the structure associated with walking rig 121.

In one or more embodiments, BOP 511 is connected on top of the wellhead 110 by conventional means known in the art. It should be noted the BOP 511 may be added to the wellhead 110 at any time during the first well's 122 life. Furthermore, a bell nipple 508 with a return line 509 may be installed above the BOP 511. The return line 509 is connected with a flow line 510, which is in fluid communication with a plurality of trip tanks 514 and a mud tank 513. A shaker 515 may receive returned mud from the return line 509 and perform solids removal prior to collection of the mud in the mud tank 513. As seen in FIG. 8, a valve 518 with a line 512 is connected to the wellhead 110 to aid in pressure release.

A second tubular string 523 having an outer diameter smaller than the inner diameter of the first tubular string 522 is lowered by tubular elevator 212 and a landing joint (of an upper landing tool 533 and a lower landing tool 534) into the wellbore 115 of the first well 122 through the BOP 511 and bell nipple 508. When the second tubular string 523 is at proper depth, a hanger 516 is added to the tubular string 523 to be landed in the spool of wellhead 110. Then, the tubular string 523 and hanger 516 can be lowered through the usage of landing joint 533, 534 and landed into the wellhead 110 spool 519. In one or more embodiments, the liner hanger 516 is a fluted hanger which comprises holes in the hanger to allow return flow. The second tubular string 523 has a plurality of tubular centralizers 524 disposed around the second tubular string's 523 outer diameter to aid in keeping the second tubular string 523 in a central position in the wellbore 115. Furthermore, a plurality of float valves 525 may be at the bottom of the second tubular string 523.

Once the hanger 516 is landed in the spool 519 of wellhead 110, the weight of the second tubular string 523 can be transferred from the traveling block 102 onto the wellhead 110. Once transferred, the second tubular string 523 is in tension from the hanger 516. The upper landing tool 533 may be removed, and the return line 509 may be modified to allow for moving of substructure 105 and rig 121. In embodiments involving cementing of second tubular string 523, a cementing head (not shown) may be installed on the lower landing tool 534, and cementing may commence while rig 121 is being moved or has been moved. In one or more embodiments, the cement head (not shown) is installed on top of the lower handling tool 534 above the bell-nipple 508 and also below the rig floor 104. Furthermore, the bell-nipple 534 may be modified to potentially reduce its height. If all these conditions can be achieved while the walking rig 121 is still above the well 122, the cement head can be installed before moving the walking rig 121. In some case, the walking rig 121 may have to be moved first to allow such installation. In most cases, the return line 509 may be temporarily removed to allow the movement of the walking rig 121. The return line 509 may be reconnected (at least for temporary operation) for the fluids displaced by the cement slurry, and the cement job may be performed. The displaced well fluids may flow through the return line 509 if a hanger 516 is fluted (allowing fluid flow therethrough) or the fluid may flow through the bleed line 512 and bleed valve 518. In either case, the returned well fluid may be directed towards mud tanks 513 or trip tanks 514. After waiting on cement (to cure), the cementing head and the landing joint are removed, and the BOP 511 shear rams may be closed to provide for a pressure containment barrier. The temporary return line 509 and bell nipple 508 may be removed, and a flange (not shown) may be added on top of the BOP 511 to ensure an additional pressure containment barrier. Additional pressure containment may include the float shoes.

After the primary cement job, cement logs may be performed. If a remedial job is required (either due to low top of cement or channels), conventional remediation methods may be performed if the new cement is pumped directly through the tubular string 532. While conventional practices may involve the use of a drill pipe, because the rig 121 has been moved, a coiled tubing may be used instead.

Figure 10:
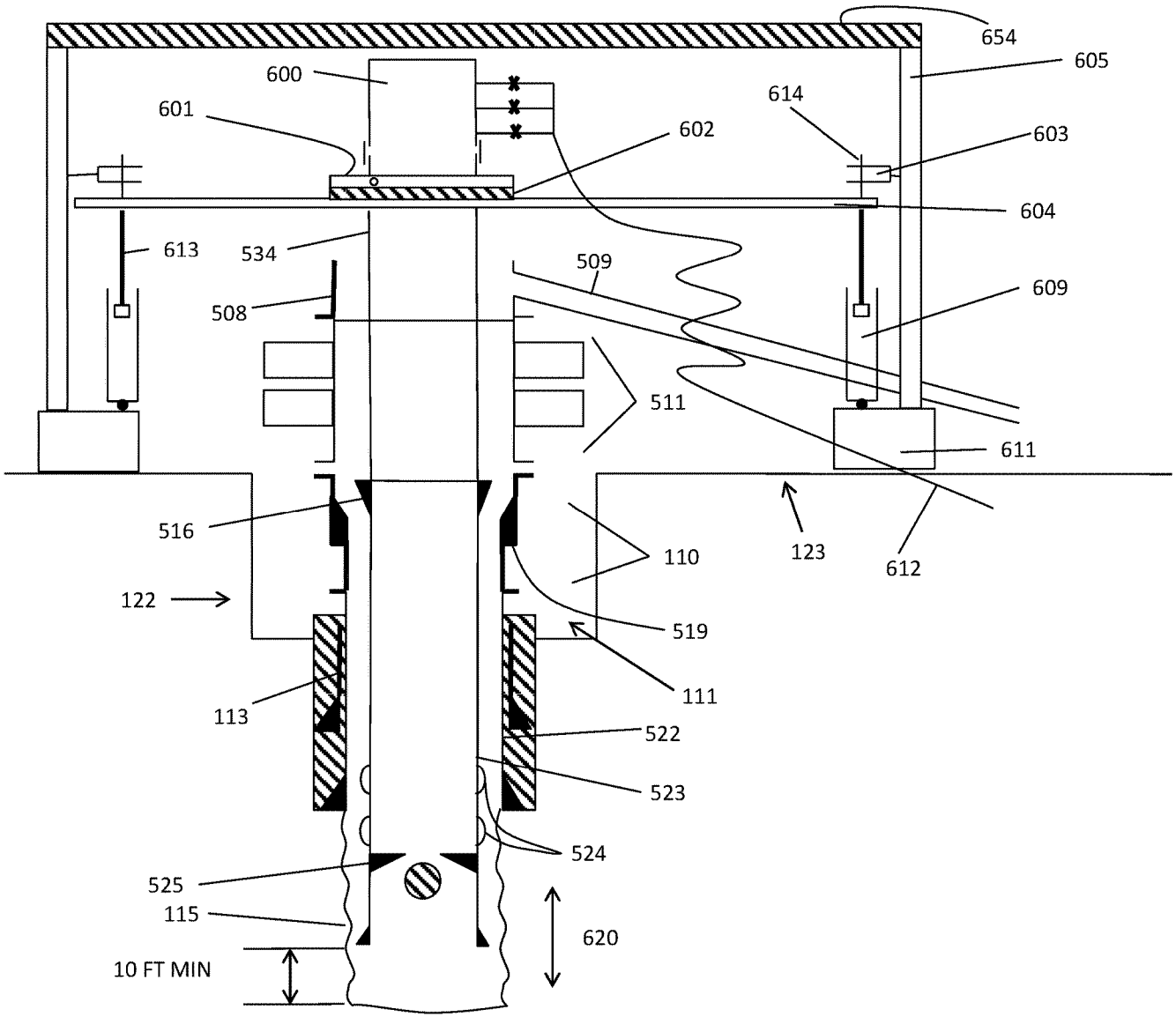
FIG. 10 illustrates a view of a system for offline cementing with tubular reciprocation according to one or more embodiments of the present disclosure.

Now referring to FIG. 10, an embodiment of a system for the offline suspension (and optional cementing) of intermediate and/or production tubular is shown to include reciprocation. The embodiment allows for the performance of tubular reciprocation when the walking rig 121 is not aligned with the well 122 after rig walking. As illustrated, a first tubular string 522 (which may, for example, be a surface tubular such as that shown in FIG. 3-6 or 8) is cemented in place in the wellbore 115 of the first well 122, and a second tubular string 523 has been lowered into the well 122 as described with respect to FIG. 9. The rig with its mast (not shown) used to drill and lower second tubular string 523 may be moved to a second well (not shown) once second tubular string 523 has reached the required depth for a cement job to be performed. While the weight of tubular string 523 was originally held by rig mast (not shown) through the tools described above, upon reaching the final depth, the weight of second tubular string 523 may be supported in the well 122 through a tubular support structure, such as a tubular support 604 that is below the rig floor 654. Specifically, the weight of the tubular string 523 terminated upwards by the lower landing tool 534 is supported by the elevator 601. The elevator 601 allows for the transfer of the weight of the tubular string 523 on the tubular support 604. In this embodiment, a hook (not shown) or the rig 121 does not support the weight of the tubular string 523, and the upper part of the landing tool (shown in FIG. 9 as 533) may be removed.

Legs 613 of tubular support 604 are connected to a plurality of actuators 609. The plurality of actuators 609 may be hydraulically powered or otherwise powered by any means know in the art to axially move the legs 613 and tubular support 604 to change the vertical position of the tubular support 604 on demand. The moving of the tubular support 604 will reciprocate the second tubular string 523 in an axial fashion as seen by a reciprocation arrow 620. This reciprocation occurs by the engagement of second tubular string 523 by lower landing tool 534, which is also engaged (supported by) with the tubular support 604. Reciprocating the second tubular string 523 may aid in proper and even distribution of a cement slurry (not shown) being pumped into the wellbore 115. Actuators 609 may be disposed on base boxes 611, which rest on floor 123. A support substructure 605, which supports the rig floor 654, is also disposed on the base boxes 611, and a plurality of guides 603 are connected to the support substructure 605. The plurality of guides 603 additionally connect to guide arms 614 extending from tubular support 604 to aid in keeping the plurality of actuators 609 running straight up and down and to moving through the desired range of axial positions to cause the tubular to reciprocate within the well 122. It is envisioned that the actuators 609 may be the same actuators that may raise the rig floor (not shown) or other elements of the rig (not shown) once the rig has moved. In such an instance, an upper attachment designed to engage with the tubular support 604/legs 613 may be used when switching between movement of the rig and the tubular support 604.

Additionally, in one or more embodiments, a rotary table 602 may be disposed on the tubular support 604 and supports the elevator 601 which in turn support the lower landing tool 534 which support the tubular string 523. With these supports, the rotary table 602 may rotate the second tubular string 523, which is will allow for proper and even distribution through the annulus of a cement slurry (not shown) being pumped into the wellbore 115, if needed. In the presence of the rotary table 602, a slip or elevator 601 will be disposed on top of the rotary table 602, and the slip or elevator 601 engage with the lower landing tool 534. If the rotary table 602 is not present, the slip or elevator 601 will be disposed on top of the tubular support 604, and the slip or elevator 601 engage with the lower landing tool 534. Reciprocation and/or rotation of the tubular string 523 may be performed during the displacement of the cement slurry in the annulus. During "waiting on cement" reciprocation and rotation may be stopped. At the end of the slurry displacement, if the tubular string 523 is equipped with landing sleeves (or integrated slips), the reciprocating system may lower the tubular string 532 via the actuators 613 so that the landing sleeve 516 rests against the landing spool 519.

Still referring to FIG. 10, in one or more embodiments, a cement head 600 is engaged with the lower landing tool 534 above the tubular support 604. Furthermore a plurality of flexible lines or chiksans 612 are connected to the cement head 600 to pump a cement slurry (not shown) down into the wellbore 115, such as by conventional means. In another embodiment, reciprocation of the tubular string 523 may be performed via the usage of BOP winches 205 when these winches 205 are used to support the tubular via a tubular elevator 206, as shown in FIG. 5.

Furthermore, methods of the present disclosure may include use of the walking rig and other structures, such as in FIGS. 1-10. Because the method may apply to any of the embodiments, reference numbers are not referenced to avoid confusion of the numbering between the different embodiments. Initially, the walking rig supports a weight of the tubular slip or elevator, the lower landing tool, the wellhead, and the tubular string. Then the weight of the tubular slip or elevator, the lower landing tool, the wellhead, and the tubular string will be transferred from the walking rig to the tubular support structure. Once the weight of the tubular slip or elevator, the lower landing tool, the wellhead, and the tubular string is transferred over to the tubular support structure, the walking rig will move as seen by the arrow from the first well to the second well. When the walking rig has positioned off the first well, the cement head will be installed on top of the lower handling tool. The weight of casing, the landing nipple, the lower landing tool and the cement head is supported by the tubular support structure prior to commencing cementing, which may occur once the rig has positioned off the first well or even while it is still positioned over the first well. However, the tubular is supported without the assistance of the rig. Once the cement head is in position, pumping of the cement slurry through the tubular string and into an annulus between the tubular string and the wellbore may begin. The amount of cement slurry being pumped, through the tubular string and into an annulus between the tubular string and the wellbore, is predetermined based on the conditions of the first well and is well known to those skilled in the art.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system for offline suspension of a tubular, comprising:

a rig movable from a first well to a second well;

a wellhead positioned above or at least partially within the first well;

a tubular string extending into the first well; and a tubular support structure above a cellar of the first well, wherein a weight of the tubular string is configured to be transferred from the rig to the tubular support structure to allow the rig to move from the first well to the second well, and wherein the tubular support structure supports the weight of the tubular string while the tubular string is cemented in place in the first well.

2. The system of claim 1, further comprising:

a cement head for supplying a cement slurry to cement the tubular string in the first well; and a return line to displace fluids from an annulus between the first well and the tubular string.

3. The system of claim 1, wherein the wellhead is disposed in the cellar of the first well.

4. The system of claim 1, wherein the tubular support structure comprises one or more BOP winches disposed on one or more rails of a substructure of the rig or below a rig floor, allowing the tubular support structure to be steady while the rig moves.

5. The system of claim 4, wherein the one or more BOP winches is configured to reciprocate the tubular string in the first well while the tubular string is cemented in place.

6. The system of claim 1, wherein the tubular support structure is a rolling bridge disposed on a rail of a BOP wrangler or installation system, allowing the tubular support structure to be steady while the rig moves.

7. The system of claim 1, wherein the tubular support structure is a bridge disposed on a floor above the cellar, wherein the bridge distributes the total supported weight on sufficient ground area and stays steady while the rig moves.

8. The system of claim 1, wherein the rig is positioned off the first well.

9. The system of claim 1, wherein the tubular support structure is configured to support the entire weight of the tubular string, without any weight being supported by the rig.

10. The system of claim 1, further comprising a substructure around the first well, wherein the substructure is disposed on a base box or on a ground floor.

11. The system of claim 10, wherein the tubular support structure also has a plurality of legs that extend into a plurality of actuators disposed on the base box and configured to axially move the tubular support structure and thereby reciprocate the tubular string within the first well.

12. The system of claim 1, further comprising a rotary table disposed in the tubular support structure so a tubular elevator may be rotated while supporting a handling tool and the tubular string and a cement head.

13. The system of the claim 1, wherein the tubular support structure comprises a tubular slip or elevator.

14. The system of claim 13, further comprising a landing tool disposed adjacent to the tubular support structure and being engaged by the tubular slip or elevator, the landing tool also being engaged with the tubular string such that the tubular string hangs in tension in the first well.

15. The system of the claim 1, wherein the tubular support structure comprises a pushing equipment disposed on a floor above the cellar, wherein the pushing equipment distributes the total supported weight on sufficient ground area and can push the tubular string into the first well.

16. The system of the claim 1, wherein no drilling rig is positioned above the first well when the rig moves from the first well to the second well, and when the tubular support structure supports the weight of the tubular string while the tubular string is cemented in place in the first well.

17. The system of the claim 1, wherein the tubular support structure supports the weight of the tubular string while the tubular string is run deeper into the first well, and wherein the tubular string is run deeper into the first well after the rig moves from the first well, and before the tubular string is cemented in place in the first well.

18. A system for offline suspension of a tubular, comprising:

a rig movable from a first well to a second well;

a first tubular string cemented in place within in the first well;

a wellhead attached to the first tubular string and having a landing spool therein;

a second tubular string extending into the first well through the wellhead and the first tubular string;

a hanger attached to an upper end of the second tubular string, the hanger configured to engage the landing spool such that the second tubular string hangs in tension from the wellhead upon engagement of the hanger with the landing spool;

a landing tool disposed above the wellhead and engaged with the second tubular string, and a tubular support structure positioned above the first well, wherein a weight of the second tubular string is configured to be transferred from the rig to the tubular support structure to allow the rig to move from the first well to the second well, and wherein the tubular support structure supports the weight of the second tubular string while the second tubular string is cemented in place in the first well.

19. The system of claim 18, further comprising:

a cement head disposed on the landing tool for supplying cement slurry to cement the second tubular string in the first well.

20. The system of claim 18, wherein the second tubular string is suspended from the tubular support structure independent from the rig prior to engagement of the hanger with the landing spool.

21. The system of claim 20, wherein the tubular support structure is configured to provide reciprocation and/or rotation of the second tubular string prior to engagement of the hanger with the landing spool.

22. The system of claim 20, further comprising a substructure around the first well, wherein the substructure is disposed on a base box.

23. The system of claim 22, wherein the base box or any part of the substructure is on a ground floor.

24. The system of claim 20, wherein the tubular support structure comprises a plurality of legs that extend into a plurality of actuators disposed on the base box and configured to axially move the tubular support structure and thereby reciprocate the second tubular string within the first well.

25. The system of claim 24, further comprising a guide disposed on the substructure to align the plurality of actuators with the tubular support structure, wherein the plurality of actuators are hydraulically powered.

26. The system of claim 20, further comprising a rotary table disposed between a cement head and the tubular support structure.

27. The system of claim 18, further comprising a blowout preventer disposed on the wellhead.

28. The system of claim 27, further comprising a flange to close the blowout preventer after removal of a bell-nipple.

29. A method for using a rig, comprising:

supporting a weight of a first tubular string with the rig at a first well, wherein a wellhead is positioned above or at least partially within the first well;

transferring the weight of the first tubular string from the rig to a tubular support structure, wherein the tubular support structure is independent from any rig that is used to drill the first well;

cementing the first tubular string in place in the first well while the first tubular string is supported by the tubular support structure; and moving the rig from the first well while the first tubular string is supported by the tubular support structure.

30. The method of claim 29, further comprising disposing a cement head on the tubular support structure once the rig has moved away from the first well.

31. The method of claim 29, further comprising pumping a cement slurry through the first tubular string and into an annulus between the first tubular string and the first well while the rig moves from or is positioned off the first well to cement the first tubular string in place.

32. The method of claim 31, further comprising sealing off the annulus from an atmosphere.

33. The method of claim 31, further comprising displacing fluids from the annulus through a return line.

34. The method of claim 29, further comprising: transferring the weight from the tubular support structure to a wellhead attached to a top of a surface tubular string cemented in the first well.

35. The method of claim 34, wherein a hanger attached to the top of the first tubular string engages a landing spool in the wellhead such that the first tubular string hangs in tension from the wellhead upon engagement of the hanger with the landing spool.

36. The method of claim 29, wherein the tubular support structure comprises one or more BOP winches disposed on one or more rails of a substructure of the rig or below a rig floor, allowing the tubular support structure to be steady while the rig moves.

37. The method of claim 36, further comprising reciprocating and/or rotating the first tubular string in the first well after the weight is transferred.

38. The method of claim 29, wherein the tubular support structure is a rolling bridge disposed on a rail of a BOP wrangler or installation system, allowing the tubular support structure to be steady while the rig moves.

39. The method of claim 29, wherein the tubular support structure is a bridge disposed on a floor above a cellar, wherein the bridge distributes the total supported weight on sufficient ground area and stays steady while the rig moves.

40. The method of claim 29, further comprising: transferring the weight from the tubular support structure after the first tubular string is cemented in place.

41. The method of claim 29, further comprising reciprocating and/or rotating the first tubular string in the first well after the weight is transferred.

* * * * *